US008142648B2

(12) United States Patent
Mak

(10) Patent No.: US 8,142,648 B2
(45) Date of Patent: Mar. 27, 2012

(54) CONFIGURATIONS AND METHODS OF RVP CONTROL FOR C5+ CONDENSATES

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 508 days.

(21) Appl. No.: 12/446,648

(22) PCT Filed: Oct. 24, 2007

(86) PCT No.: PCT/US2007/022597

§ 371 (c)(1),
(2), (4) Date: Apr. 27, 2009

(87) PCT Pub. No.: WO2008/057231

PCT Pub. Date: May 15, 2008

(65) Prior Publication Data

US 2010/0024473 A1 Feb. 4, 2010

Related U.S. Application Data

(60) Provisional application No. 60/863,021, filed on Oct. 26, 2006.

(51) Int. Cl.
*B01D 3/14* (2006.01)
*F25J 3/00* (2006.01)

(52) U.S. Cl. ..... 208/347; 208/362; 208/369; 196/139; 62/618; 62/620

(58) Field of Classification Search ..... 585/738, 585/800; 208/347, 362, 369; 196/139; 62/617, 62/618, 620, 630, 631; 203/2
See application file for complete search history.

(56) References Cited

U.S. PATENT DOCUMENTS

| | | | | |
|---|---|---|---|---|
| 4,036,735 | A | 7/1977 | Roselius et al. | |
| 4,174,357 | A | 11/1979 | Chapman | |
| 4,462,813 | A | 7/1984 | May | |
| 4,507,133 | A | 3/1985 | Khan | |
| 4,578,151 | A * | 3/1986 | Soderstrom et al. | 203/1 |
| 5,047,125 | A * | 9/1991 | Meier et al. | 203/2 |
| 6,023,942 | A | 2/2000 | Thomas et al. | |
| 6,658,893 | B1 | 12/2003 | Mealey | |

* cited by examiner

*Primary Examiner* — Walter D Griffin
*Assistant Examiner* — Renee E Robinson
(74) *Attorney, Agent, or Firm* — Fish & Associates, PC

(57) ABSTRACT

Controlled RVP C5+ products are produced from feed gas in configurations and methods in which a heavier portion of the feed gas is fractionated into several streams having distinct RVP and in which a C5+ stream is produced from the lighter portion of the feed gas. The so formed streams are then combined to produce C5+ products with controlled RVP. Thus, RVP control is achieved without the need for external products for blending process streams derived from the feed gas.

17 Claims, 2 Drawing Sheets

Prior Art Figure 1

CONFIGURATIONS AND METHODS OF RVP CONTROL FOR C5+ CONDENSATES

This application claims priority to our U.S. provisional patent application with the Ser. No. 60/863,021, which was filed Oct. 26, 2006.

FIELD OF THE INVENTION

The field of the invention is gas processing, especially as it relates to production of gas condensates from high-pressure vapor/liquid hydrocarbon mixtures.

BACKGROUND OF THE INVENTION

C5+ condensates (i.e., hydrocarbon mixtures predominantly comprising C5, C6, and heavier hydrocarbons) are often produced in natural gas processing plants and can be sold as commodity as such condensates can often be processed to transportation fuels. Unfortunately, C5+ condensates produced from upstream facilities often contain relatively high amounts of undesirable mercaptans and higher vapor pressure components, and must therefore be further processed to meet the environmental and transportation specifications, including Reid Vapor Pressure (RVP) values, ASTM distillation end point temperatures, and maximum mercaptan contaminant contents.

For example, current C5+ condensate product specifications require the condensate to have an RVP of 12 psia and a sulfur content of no more than 100 ppm by weight, which often requires removal of most of the C5 and lighter components. As C5+ condensates are typically produced from high-pressure sour gas fields, relatively large quantities of C4, C5, and lighter hydrocarbons, and various sulfur contaminants are often present. Presently known methods of removing these lighter components generally result in reduction in condensate production and loss in product revenue. To remedy loss of revenue, many of the currently known gas processing configurations and methods are forced to implement additional processing steps. For example, C5+ condensates can be blended with low RVP naphtha to produce a blended product with a lower RVP. Alternatively, or additionally, the C5+ condensate stream can be hydro-processed for conversion and ultimately removal of the sulfur contaminants, all of which adds complexity to the oil/gas separation facilities and increases operating and capital costs.

Alternatively, plant configurations could be developed to produce a C5+ condensate from high-pressure hydrocarbon mixtures that meets the C5+ product specification without sacrificing production. However, despite several known configurations for gas condensate separation, configurations that produce a condensate that meets C5+ product specification without negative impact on economics have not yet been described. For example, U.S. Pat. No. 4,702,819 to Sharma et al. teaches use of dual fractionation zones in which the first fractionation zone employs a side reboiler and a vapor sidestream. While such configurations allow for at least somewhat desirable levels of gas/liquid separation, the production of a low RVP C5+ condensate is still very difficult. In another known configuration, as exemplified in U.S. Pat. No. 4,462,813 to May et al., a multi-stage compressor is connected to a wellhead, refrigeration unit, and separators. Similar to Sharma's configuration, May's configuration is relatively inefficient and energy intensive and not suitable to produce C5+ condensates with low RVP specifications, particularly when processing high-pressure hydrocarbon mixtures comprising significant quantities of C5 and lighter components.

In still further known examples, as described in RE 33,408 or U.S. Pat. No. 4,507,133 to Khan et al., the vapor stream from a deethanizer is cooled to liquefaction and contacted with a vapor phase from the hydrocarbon feed stream to separate methane, ethane, and propane vapors from the feed. Similarly, as described in U.S. Pat. No. 6,658,893 to Mealey, the feed gas is cooled to liquefy the heavier components and at least some of the C2 and lighter components. Subsequent condensation and absorption steps then allow high recovery of LPG components (i.e., C3 and C4+). Such processes are often limited to high yields of C3 and C4+ components, and are generally not suitable for heavier C5+ condensate components.

Thus, while numerous configurations and methods for gas condensate hydrocarbon separation are known in the art, all or almost all of them suffer from one or more disadvantages. Therefore, there is still a need for improved configurations and methods for gas condensate separation, and especially for gas condensate separation from high-pressure hydrocarbon mixtures that must meet the vapor pressure requirements of the C5+ product.

SUMMARY OF THE INVENTION

The present invention is directed to configurations and methods in which one or more C5+ products with controlled and desirable RVP are produced from a high-pressure feed gas. In especially preferred aspects, the feed gas is separated into a heavier and a lighter portion, and the heavier portion of the feed gas is fractionated into a distillate, midstream, and bottom fraction, while the lighter portion of the feed gas is processed to form a C5+ stream. The high-RVP distillate is then combined with the low-RVP bottom fraction to produce a first controlled RVP product, and the moderately high-RVP C5+ stream and moderately low-RVP mid-stream are combined to produce a second controlled RVP product.

In one aspect of the inventive subject matter, the plant comprises a fractionator that receives a C5+ hydrocarbon mixture feed and produces an overhead distillate, a mid-stream product, and a bottom product. A first mixing device is coupled to the fractionator and mixes the overhead distillate and the bottom product to form a first C5+ product having a controlled RVP, while a second mixing device is coupled to the fractionator and a C5+ source and mixes the C5+ stream from the C5+ source with the mid-stream product to thereby form a second C5+ product having a controlled RVP.

Most preferably, the C5+ source is a debutanizer that provides a debutanizer bottom product as the C5+ stream, and a condensate stabilizer (typically coupled to the debutanizer) is configured to produce the C5+ hydrocarbon mixture from a high-pressure feed gas. It is still further preferred that the plant includes a natural gas liquids (NGL) recovery unit that is coupled disposed between the condensate stabilizer and the debutanizer. With respect to the RVP values of the stream, it is contemplated that the first C5+ product and/or the mid-stream product typically has an RVP of between 2 and 8, and that the second C5+ product and/or the overhead distillate typically has an RVP of at least 10. The C5+ stream typically has an RVP of atleast 12.

In another aspect of the inventive subject matter, a method of forming C5+ products with controlled RVP will include a step of separating a feed gas in a separation unit to thereby form a gaseous fraction and a liquid fraction. In another step, the gaseous fraction is separated to form a C5+ stream, while the liquid fraction is processed in a fractionator to produce an overhead distillate, a mid-stream product, and a bottom product. The overhead distillate and the bottom product are then combined to form a first C5+ product having controlled RVP and the mid-stream product and the C5+ stream are combined to form a second C5+ product having controlled RVP.

Most preferably, the separation unit comprises a condensate stabilizer and the feed gas is a high-pressure feed gas. In such configurations, it is contemplated that the gaseous fraction is further processed to provide NGL and a C5+ stream (most typically produced in a debutanizer that is fluidly coupled to a NGL recovery unit). In further contemplated aspects, the first and second C5+ products having controlled RVP are formed in respective first and second mixing devices, wherein the first C5+ product and/or the mid-stream product has an RVP of between 2 and 8, and wherein the second C5+ product and/or the overhead distillate has an RVP of at least 10. The C5+ stream in such methods will typically have an RVP of at least 12.

Various objects, features, aspects and advantages of the present invention will become more apparent from the following detailed description of preferred embodiments of the invention, along with the accompanying drawing.

BRIEF DESCRIPTION OF THE DRAWING

Prior Art

DETAILED DESCRIPTION

The inventor has discovered that C5+ condensates with a desirable and predetermined RVP can be prepared from various sources in a simple and effective manner. In especially preferred aspects of the inventive subject matter, a heavy fraction of a feed gas (e.g., a bottom product of a condensate stabilizer) is fed to a C5+ fractionator that produces an overhead distillate, a mid hydrocarbon fraction, and a bottom product. The mid hydrocarbon fraction is then used for blending with a C5+ condensate having relatively high RVP (e.g., debutanizer bottom product) to form a first low RVP product. The high RVP distillate and the low RVP bottom product are also combined to form a second low RVP product.

Preferably, the hydrocarbon source provides a high-pressure hydrocarbon stream that comprises a relatively large amount of C5 and lighter components (85% or higher). Thus, suitable sources for C5+ condensates include natural gas and non-natural gas processing plants (e.g., petroleum refineries). Most typically, the C5+ condensates are provided by one or more components of a gas processing plants, including condensate stabilizers, debutanizer, etc. In one especially preferred aspect of the inventive subject matter, contemplated plants include a C5+ condensate fractionator that is configured to receive C5+ hydrocarbons from a condensate stabilizer unit, wherein the C5+ condensate fractionator is configured to operate under conditions to produce an overhead distillate containing the lighter hydrocarbon fraction (mainly C5 to C7), a mid-hydrocarbon fraction (C7 to C8+), and a bottom product (mostly C7+ and heavier). The mid hydrocarbon fraction is preferably used for blending with the C5+ condensate produced from a debutanizer or other suitable source for RVP control.

Preferably, the mid hydrocarbon fraction has a ASTM end point of about 230° F. to about 350° F. and RVP between 3 and 9 psia. Therefore, the draw location for the mid-hydrocarbon fraction is typically in the upper section of the C5+ condensate fractionator. Depending on the composition and/or RVP of the mid fraction and/or debutanizer C5+condensate, it should be appreciated that the flow ratio of the mid hydrocarbon fraction to the debutanizer C5+ condensate stream can vary between 0.1 to 1.0. Contemplated configurations also include a mechanism to allow blending of the overhead distillate product from the C5+ condensate fractionator with its bottom product to thereby form a blend that is suitable for further processing in refineries. Of course, where required or otherwise desirable, at least a portion of the overhead distillate product and/or the fractionator bottom product may also be blended with the mid hydrocarbon fraction (and/or other (e.g., debutanizer) C5+ condensate fraction).

Figure 1:
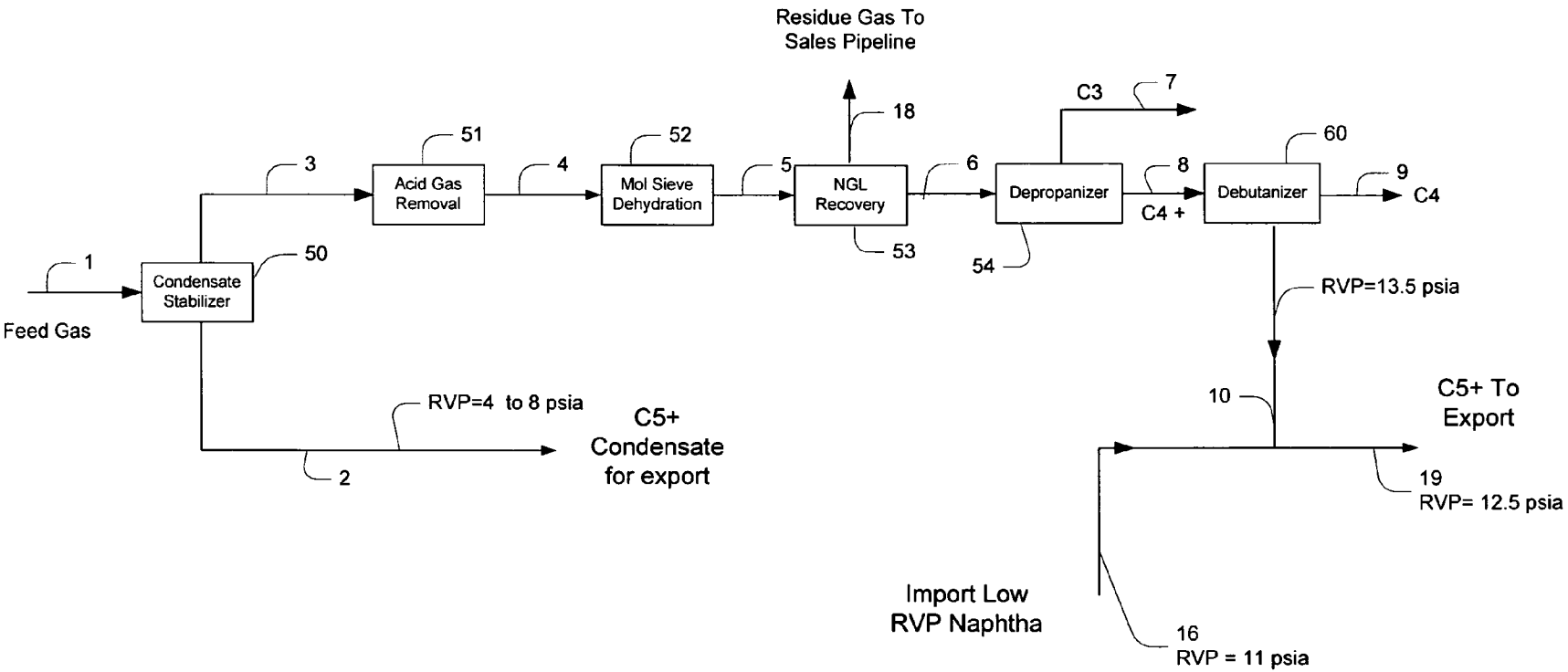
FIG. 1 is a schematic illustration of an exemplary known configuration for gas condensate recovery plant.

It should be noted that such configurations and methods have not been appreciated in the art. An exemplary known configuration for separating C5+ condensate hydrocarbon from a gas processing plant is depicted in Prior Art FIG. 1. Here, the feed gas stream 1 is first separated in the condensate stabilizer unit 50 into a vapor stream 3 containing C5 and lighter hydrocarbons and a bottom liquid stream 2 containing mostly the C5 and heavier components. The condensate stabilizer unit typically comprises compressors, a separator and a stripper or fractionator (not shown), and is generally configured to produce a C5+ product with an RVP of 4 to 8 psia. This RVP requirement is necessary to ensure product storage and transportation safety.

Stream 3 is further processed in an acid gas removal unit 51 that removes the acid gas components from the feed gas necessary for sales gas specification. The so treated gas stream 4 is dried in molecular sieve dehydrators 52 producing a dried vapor stream 5, which prevents hydrate formation or freezing in the cryogenic section of the NGL recovery unit 53. The dried gas is further processed in NGL recovery unit 53 which produces a C3+ product 6 and residue gas stream 18. The residue gas is sent to the sales gas pipeline network while the C3+ product is fractionated in depropanizer unit 54 into a C3 product, stream 7, and a C4+ product, stream 8, which is further fractionated in debutanizer 60 into a C4 product, stream 9, and a C5+product, stream 10.

It should be appreciated that since most of the heavier components (C7 and heavier components) have already been removed in the upstream condensate stabilizer unit, residual heavier hydrocarbons in the feed to the debutanizer are significantly reduced. Consequently, the C5+ condensate stream from the debutanizer bottom does not have sufficiently heavier hydrocarbons (e.g., C7+) needed for a low RVP product. Therefore, the RVP of the C5+ condensate from the debutanizer is typically about 13.5 psia or higher, which is problematic for most export, transport, and/or storage uses. One of the solutions to reduce the high RVP value is importing low RVP naphtha (e.g., RVP of 11 psia or lower, stream 16) that can be blended with the high RVP C5+ condensate, forming a blended mixture stream 19 with RVP of 12.5 psia meeting the product specification. Typically, the blending ratio of the import naphtha to the C5+ condensate is inversely proportional to the RVP of the import naphtha. Unfortunately, this blending operation relies on the quality and availability of import naphtha which may be unreliable.

Figure 2:
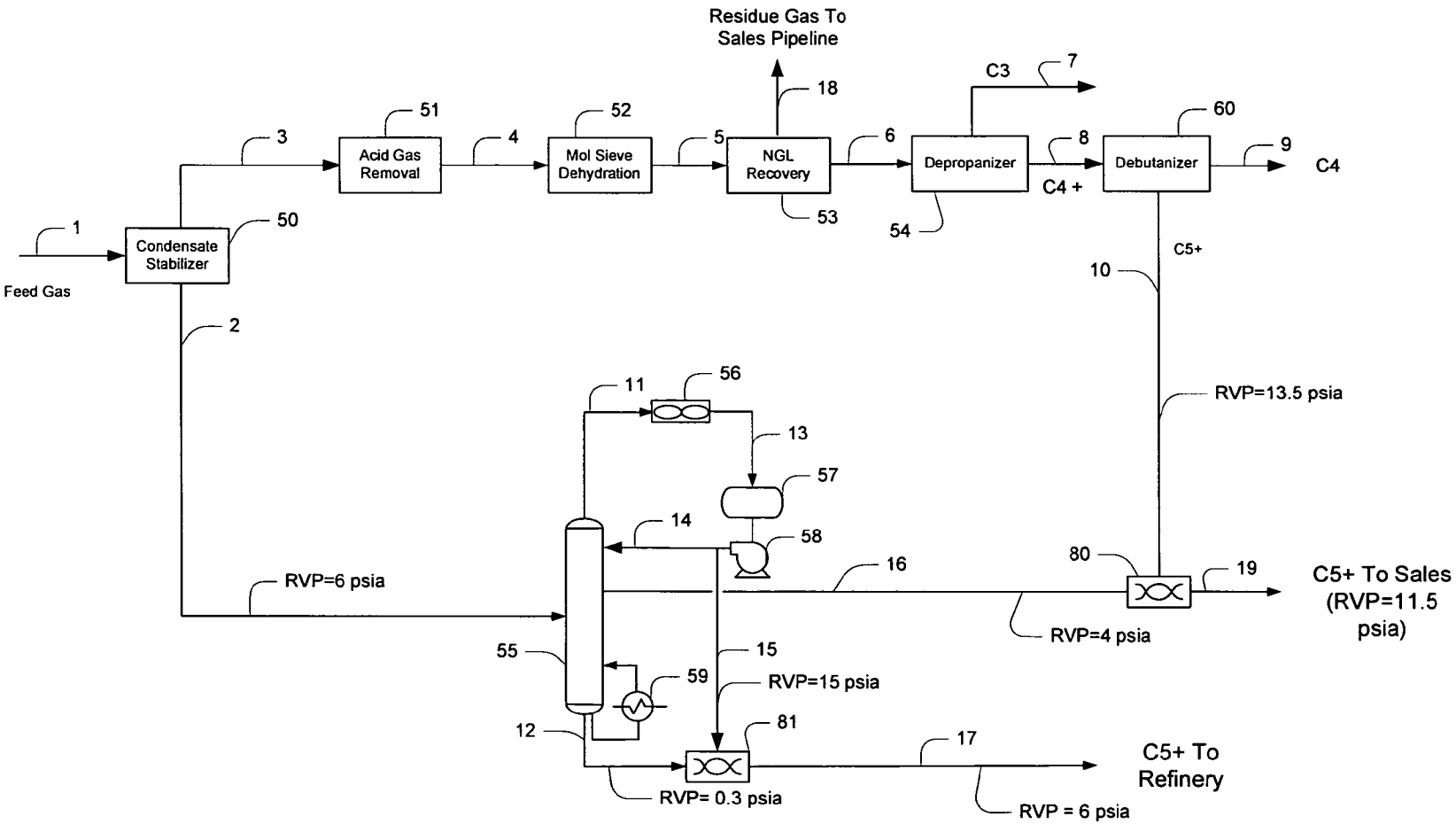
FIG. 2 is a schematic illustration of one exemplary configuration for gas condensate recovery according to the inventive subject matter.

In contrast, FIG. 2 depicts an exemplary configuration in which the C5+ condensate RVP is effectively lowered without reliance on blending stock from an external source (e.g., import naphtha). Here, the stabilizer bottom stream 2 is fed to the condensate fractionator 55 that produces three product streams, overhead distillate stream 15 having an RVP of about 14.4 psia, a mid fraction stream 16 having an RVP of about 4 psia, and a bottom fraction 12 having an RVP of about 0.3 psia. In a typical operation, the fractionator preferably operates at about 15 psig overhead pressure and is reboiled with reboiler 59 operating at about 395° F. The fractionator overhead stream 11, typically at 185° F. is condensed in air cooler 56 to thereby produce overhead distillate product 13, typically at about 155° F. The overhead distillate stream, after being separated in drum 57, is pumped by pump 58 to about 30 psig. A portion of the pump discharge is used as reflux 14 to the fractionator and the remaining portion (stream 15) is used for blending with the bottom product stream 12 using a mixing or blending device 81. It should therefore be appreciated that the overhead distillate product stream 15 when blended with the bottom stream 12 produces C5+ condensate product 17 with RVP of about 6 psia or lower.

It should also be appreciated that the fractionator 55 produces a side draw stream 16 that contains mostly the C7 to C8 hydrocarbons with an ASTM end point around 236° F. and RVP of about 4 psia, which when combined with the C5+ condensate 10 from the debutanizer, produces a mixed stream 19 with an RVP of 11.5 psia or lower. The use of a blending or mixing device 80 may be necessary to assure uniform mixing. There are numerous mixing devices known in the art, and all known mixing devices are deemed suitable for use herein, including static mixers, impeller mixers, etc. In certain embodiments, it is also contemplated that mixing is not critical, and in such instances, the mixing device may be a manifold or other device (Y-joint) in which two streams are combined to form a single stream. Furthermore, it should be appreciated that the flow control of the streams that are to be combined may be implemented in numerous manners. However, it is generally preferred that an automated system (typically computer controlled) will adjust the flow rate of the respective streams based on real-time or predetermined information about the RVP of the respective streams.

In most typical configurations and methods, and depending on the type and chemical composition of the gas feed, it is generally contemplated that the first C5+ product and the mid-stream product has an RVP of between 2 and 8, and more typically between 3 and 7. The mid stream hydrocarbon will typically have a lower RVP than the first C5+ product (which is a combination of the fractionator bottom product and the overhead distillate), and in most cases be between about 2 and 6, and most typically between 3 and 5. The second C5+product will typically have an RVP of less than about 12, and more preferably of less than 11. With respect to the overhead distillate and the C5+ stream (e.g., from the debutanizer) it is generally contemplated that the RVP is at least 12, and more typically between 13 and 17. As still further used herein, the term "about" when used in conjunction with numeric values refers to an absolute deviation of less or equal than 10% of the numeric value, unless otherwise stated. Therefore, for example, the term "about 10 mol %" includes a range from 9 mol % (inclusive) to 11 mol % (inclusive).

An exemplary summary of the ASTM distillation temperatures and RVP properties for the various streams is shown in Table 1 below. With respect to remaining numerals and components in FIG. 2, the same considerations for like components and numerals in FIG. 1 apply.

TABLE 1

| | Stream No. | | | | | | |
|---|---|---|---|---|---|---|---|
| ASTM D86 Curve: | 2 | 15 | 16 | 12 | 17 | 10 | 19 |
| Initial boiling point, ° F. | 99 | 99 | 146 | 270 | 124 | 97 | 99 |
| End Point, ° F. | 230 | 229 | 234 | 536 | 508 | 215 | 216 |
| RVP, psia | 5.7 | 14.4 | 4 | 0.36 | 6.2 | 13.5 | 11.5 |

It should be especially appreciated that contemplated configurations, when compared to heretofore known configurations and processes, provide significant reduction in RVP and the mercaptan contaminants in the C5+ condensate product without any additional processing steps or import of low RVP naphtha for blending. Consequently, contemplated methods of producing C5+ condensate sales products will include operating a C5+ condensate fractionator such that the fractionator produces a distillate, a mid fraction, and a bottom fraction. The mid fraction is then blended with a debutanizer C5+ condensate to lower its RVP property and, the distillate fraction is blended with the bottom fraction of the condensate fractionator forming an additional C5+ condensate product with an even lower RVP.

Thus, specific embodiments and applications of RVP control for C5+ condensates have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A plant comprising:

a fractionator configured to receive a C5+ hydrocarbon mixture feed and to produce from the C5+ hydrocarbon mixture an overhead distillate, a mid-stream product, and a bottom product;

a first mixing device that is fluidly coupled to the fractionator and configured to mix the overhead distillate and the bottom product to form a first C5+ product having a controlled RVP;

a second mixing device that is fluidly coupled to the fractionator and a C5+ source, wherein the C5+ source is configured to provide a C5+ stream; and wherein the second mixing device is configured to mix the mid-stream product and the C5+ stream to form a second C5+ product having a controlled RVP.

2. The plant of claim 1 wherein the C5+ source is a debutanizer, and wherein the C5+ stream is a debutanizer bottom product.

3. The plant of claim 1 further comprising a condensate stabilizer that is configured to form the C5+ hydrocarbon mixture from a high-pressure feed gas.

4. The plant of claim 3 wherein the condensate stabilizer is fluidly coupled to the debutanizer.

5. The plant of claim 4 wherein a natural gas liquids recovery unit is fluidly coupled to and located between the condensate stabilizer and the debutanizer.

6. The plant of claim 1 wherein at least one of the first C5+ product and the mid-stream product has an RVP of between 2 and 8.

7. The plant of claim 1 wherein the second C5+ product has an RVP of less than 12.

8. The plant of claim 1 wherein at least one of the overhead distillate and the C5+ stream has an RVP of at least 12.

9. A method of forming C5+ products having controlled RVP, comprising:

separating a feed gas in a separation unit to thereby form a gaseous fraction and a liquid fraction;

processing the gaseous fraction to form a C5+ stream, and processing the liquid fraction in a fractionator to form an overhead distillate, a mid-stream product, and a bottom product;

combining the overhead distillate and the bottom product to form a first C5+ product having controlled RVP; and combining the mid-stream product and the C5+ stream to form a second C5+ product having controlled RVP.

10. The method of claim 9 wherein the separation unit comprises a condensate stabilizer.

11. The method of claim 9 wherein the feed gas is a high-pressure feed gas.

12. The method of claim 9 wherein the step of processing the gaseous fraction comprises fractionating NGL from the gaseous fraction in an NGL recovery unit.

13. The method of claim 12 wherein a debutanizer is fluidly coupled to the NGL recovery unit and provides the C5+ stream.

14. The method of claim 9 wherein the first and second C5+ products having controlled RVP are formed in respective first and second mixing devices.

15. The method of claim 9 wherein at least one of the first C5+ product and the mid-stream product has an RVP of between 2 and 8.

16. The method of claim 9 wherein the second C5+ product has an RVP of less than 12.

17. The method of claim 9 wherein at least one of the overhead distillate and the C5+ stream has an RVP of at least 12.

* * * * *